United States Patent [19]

Green et al.

[11] Patent Number: 4,511,179

[45] Date of Patent: Apr. 16, 1985

[54] THEFT-PROOF SELECTIVELY POSITIONABLE OUTDOOR CHAIR

[76] Inventors: Lawrence E. Green, 1859 Powell St.; William R. Morrish, 544 Union St., both of San Francisco, Calif. 94133

[21] Appl. No.: 375,928

[22] Filed: May 7, 1982

[51] Int. Cl.[3] ..... A47C 1/12

[52] U.S. Cl. ..... 297/349; 248/156; 297/313; 297/346

[58] Field of Search ..... 297/331, 349, 335, 313, 297/346, 232, 418, 419, 420, 421; 248/156; 52/8; 108/48

[56] References Cited

U.S. PATENT DOCUMENTS

| | | | |
|---|---|---|---|
| 451,291 | 4/1891 | McCormick et al. | 297/331 |
| 1,271,170 | 7/1918 | Jellinek et al. | 297/349 |
| 1,347,594 | 7/1920 | Salinger | 297/349 |
| 2,245,951 | 6/1941 | Agee | 108/48 |
| 2,792,951 | 5/1957 | White | 297/349 |
| 3,029,106 | 4/1962 | McGuire | 297/349 |
| 3,519,234 | 7/1970 | Matson | 248/156 |
| 4,025,108 | 5/1977 | Leighty et al. | 297/335 |
| 4,358,083 | 11/1982 | Haubrich | 248/156 |

FOREIGN PATENT DOCUMENTS

| | | | |
|---|---|---|---|
| 3025506 | 2/1982 | Fed. Rep. of Germany | 297/313 |
| 587759 | 1/1959 | Italy | 297/313 |
| 16561 | of 1913 | United Kingdom | 297/331 |
| 774708 | 5/1957 | United Kingdom | 297/313 |
| 2044095 | 10/1980 | United Kingdom | 297/421 |

*Primary Examiner*—Victor N. Sakran
*Assistant Examiner*—Mark W. Binder
*Attorney, Agent, or Firm*—Townsend & Townsend

[57] ABSTRACT

A chair which is fixed in a single location yet which may be selectively positioned to face any direction includes a seat member, a back member, and two or three legs, a first leg of which is structured to provide an approximately vertical pivot axis disposed at the rear of the chair midway between its sides. A cross member secured perpendicular to the first leg proximate the upper edge of the seat back defines a horizontal axis about which the chair can be pivoted. Arm rests provide grip means disposed toward the front of the chair at a position which gives the user a mechanical advantage so as to easily effect simultaneous pivotal movement about the horizontal and vertical pivot axes. Lightweight in construction, the chair can be readily positioned by the user in any desired direction with an easily executed movement.

7 Claims, 6 Drawing Figures

THEFT-PROOF SELECTIVELY POSITIONABLE OUTDOOR CHAIR

BACKGROUND OF THE INVENTION

The invention relates to outdoor furniture and is particularly addressed to a seat for use in parks and other public gathering places.

The park bench is a familiar feature of outdoor gathering places. For generations the elderly, the young, the wealthy, and the impecunious have all found a Sunday respite on the park bench. But notwithstanding its long and universal acceptance, the park bench has its annoying features, which the public has long had to bear and has come to accept as inevitable.

For example, groups of benches are typically arranged in a straight line along a walkway or in a circle around a statue, flower bed or the like. In such arrangements the focus of the bench sitter's attention is predetermined by the landscape architect, giving no opportunity for user involvement. Some persons prefer to face other people. Some prefer to avoid them. Some persons prefer to face toward the sun. Others prefer to face away. The typical Vitorian park bench cannot accommodate individual desires in this regard. In addition, the forced side-by-side seating tends to make conversation awkward and strained. It hardly encourages intimate conversation. When the bench sitter is alone, however, the bench tends to attract unwanted conversationalists. Undisturbed solitude is virtually impossible.

SUMMARY OF THE INVENTION

The invention provides a chair for an individual person which is especially suited for use outdoors in public gathering places and which can effortlessly be turned to face any direction, toward other such chairs or away from them, yet which is permanently installed, secure against theft. Briefly, the invention provides a chair having two or three legs, wherein one leg is structured to provide an approximately vertical pivot axis disposed at the rear of the chair and midway between its sides; the chair further includes means structured to pivot about a horizontal pivot axis disposed at the rear of the chair and intersecting the vertical pivot axis so as to enable simultaneous horizontal and vertical pivotal movement about the point of intersection. Grip means is disposed toward the front of the chair in a position providing a mechanical advantage to the user for easily effecting the simultaneous pivotal movement about the aforementioned point of intersection. The first leg positioned at the rear of the chair is adapted to be permanently fixed in the ground in approximately vertical orientation. The front portion of the chair is supported by a pair of front legs, or equivalently by a single centrally disposed leg, which leg or legs are not fixed in the ground, but which are free to be raised and rotated to a selected direction.

In a preferred embodiment of the invention the chair is constructed of modular component parts, which can be shipped disassembled from one another in quantity in a comparatively compact form and readily assembled at the outdoor location. This embodiment of the chair comprises a single rear leg formed of a first elongate member adapted at one end to be fixed in the ground with a second member irremovably mounted on the first elongate member for pivotal movement about its longitudinal axes. The second member is provided with a perpendicular cross member, which defines a second pivot axis perpendicular to the first, longitudinal pivot axis. The chair comprises a right member and a left member, each having a first end portion, an intermediate portion, and a second end portion. The first end portions provide right and left front legs, and the two intermediate portions provide right and left arm rests, which are shaped to provide forwardly disposed grip means. The second end portions are each adapted to mount co-axially to the cross member of the single rear leg for pivotal movement about the second pivot axis. Finally, a seat member and a back member are adapted to be secured to the right and left members.

The chairs of the present construction may be effortlessly positioned equally well by an elderly person or by a youngster to face any desired direction. When the chairs are installed in clusters, certain chairs of the cluster may be turned to face one another so as to facilitate conversation, while other chairs of the cluster may be turned away if the sitter prefers not to participate in or be distracted by the conversation.

It is a feature of the present invention that the chair design in and of itself makes it apparent to a user how the chair is to operate. Any attempt to move the chair by grasping one or both arm rests will automatically produce the correct motion. It is a feature of the design that the full length of the arm rest acts as a lever arm giving the user a substantial mechanical advantage in moving the chair.

For a further appreciation and understanding of the invention and its advantages, reference should be made to the following portions of the specification and the drawings.

DETAILED DESCRIPTION OF THE PREFERRED EMBODIMENTS

Figure 1:
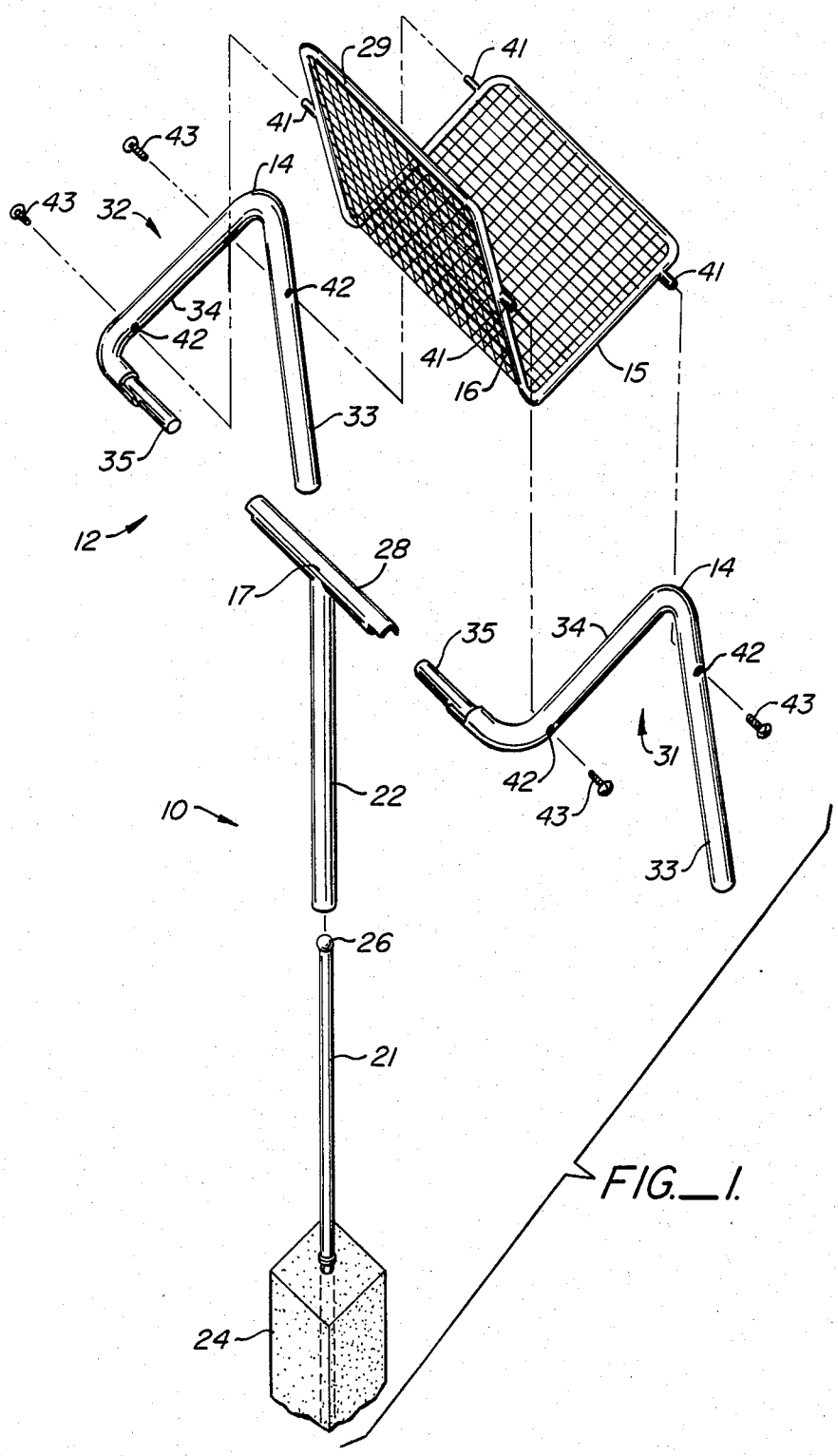
FIG. 1 is an exploded perspective view of an outdoor chair constructed according to the invention.
Figure 2:
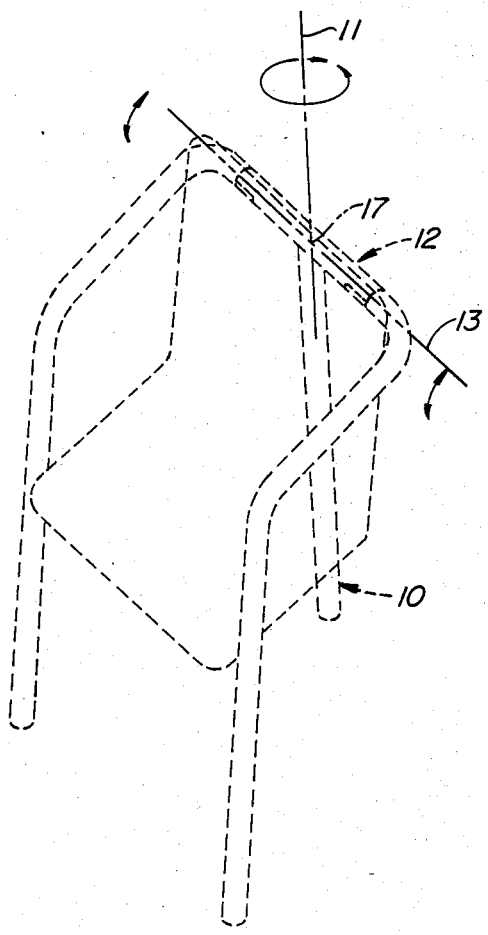
FIG. 2 is a perspective view of the chair in phantom showing the horizontal and vertical pivot axes.

As illustrated in FIG. 1 an outdoor chair constructed in accordance with the invention comprises a single rear leg 10 structured to rotate around an approximately vertical pivot axis (axis 11 in FIG. 2), means indicated generally at 12 structured to pivot about a horizontal pivot axis (axis 13 in FIG. 2), grip means 14 disposed toward the front of the chair, a seat member 15, and a back member 16. The single rear leg 10 is located midway between the sides of the chair both for balance and for symmetry of movement about vertical pivot axis 11.

In the embodiment of FIG. 1 horizontal and vertical pivot axes 13 and 11 intersect each other at intersection points 17 so as to facilitate pivotal movement about both axes simultaneously. Although the illustrated embodiment shows the vertical and horizontal pivot axes 11 and 13 intersecting in an exact point 17, such precise intersection is not required to achieve the desired simultaneous horizontal and vertical pivotal movement. Thus, means 12 defining the horizontal pivot axis 13 may be offset slightly from the vertical pivot axis 11 without detracting from the advantages of the invention, and indeed such an offset may be convenient in some equivalent constructions for securing means 12 to leg 10. As used herein the term "intersection point" is understood to mean a region of approximate intersection of the two axes and encompasses the configuration in which the two axes are offset slightly from one another.

Rear leg 10 comprises a stationary member 21 and an elongate tubular member 22, which is pivotally mounted to stationary member 21. The member 21 is adapted at end 23 to be fixed in the ground, for example, by being set in concrete footing 24. Member 21 is provided with means, such as flange 25, for setting the distance which end 23 extends into the ground. See FIG. 3.

Fixed in the ground in this manner, member 21 cannot be readily removed by thieves or vandals. To prevent removal of tubular member 22 and the chair itself from stationary member 21, the member 21 is provided with an enlarged spherical cap 26, and tubular member 22 is provided with inwardly extending annular rim 27. The enlarged spherical cap 26 and rim 27 cooperate to prevent the tubular member 22 from being readily removed. The means 26 and 27 are especially effective in discouraging theft in that they are inaccessibly mounted and cannot be circumvented with simple tools such as screw drivers and crow bars.

Stationary member 21 is preferably formed of one inch steel rod and tubular member 22 is formed of one and one-half inch steel pipe. Spherical cap 26 is formed of a steel ball welded to member 21 and having a diameter only slightly less than the inside diameter of tubular member 22. Annular rim 27 is preferably provided by a ring welded to the base of tubular member 22. Ring 27 hugs the outer cylindrical surface of stationary member 21, and steel ball 26 fits snugly within tubular member 22. Constructed in this manner, rim 27 and spherical cap 26 cooperate to assure uniform rotation without binding of tubular member 22 about stationary member 21. It is advantageous that rim 27 and spherical cap 26 be constructed of non-corroding steel or other non-corroding material to prevent binding. Inwardly extending rim 27 also serves to prevent leaves and other debris from entering into the region between members 21 and 22 and interfering with rotational movements.

Figure 3:
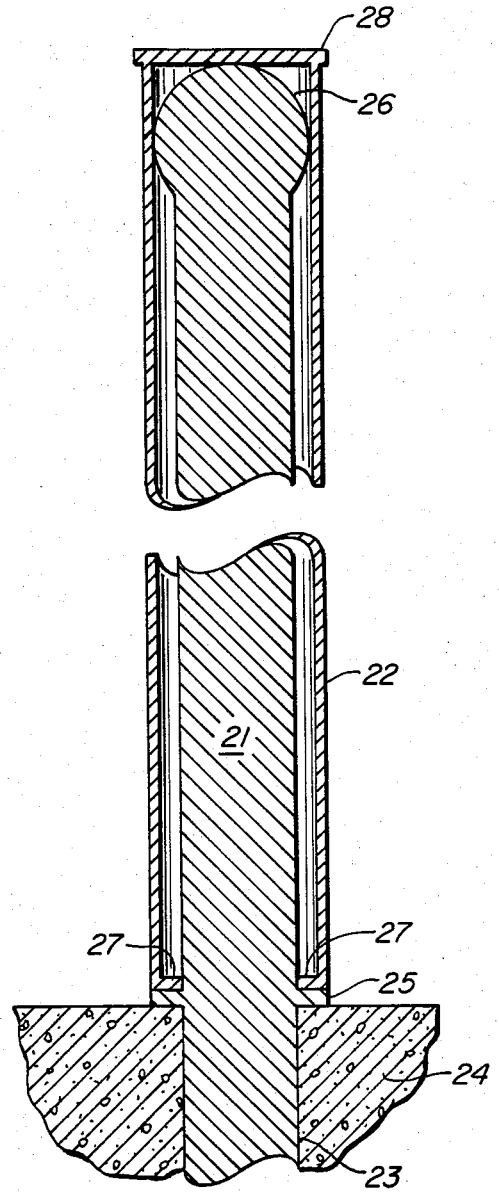
FIG. 3 is a cross-sectional view showing a preferred construction of the rear leg fixed in the ground.

Means 12 defining horizontal pivot axis 13 is provided by a tubular cross member 28 which is secured, for example by welding, in perpendicular relation to elongate tubular member 22. For ease of pivoting it is preferable that cross member 28 defining horizontal pivot axis 13 be positioned above the level of seat member 15 and preferably proximate the upper edge 29 of seat back member 16. As illustrated in FIG. 3, tubular member 22 extends a predetermined distance from flange 25 to cross member 28 so as to position cross member 28 in its optimum location proximate upper edge 29.

Figure 4:
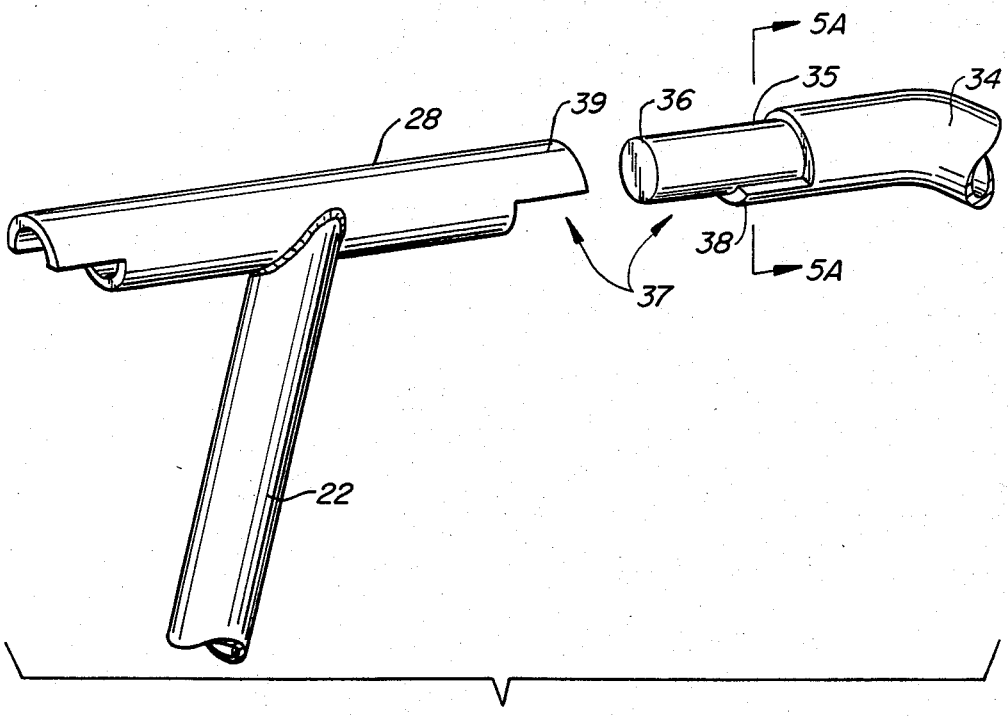
FIG. 4 is a perspective view showing stop means for limiting motion about the horizontal pivot axis.
Figure 5A:
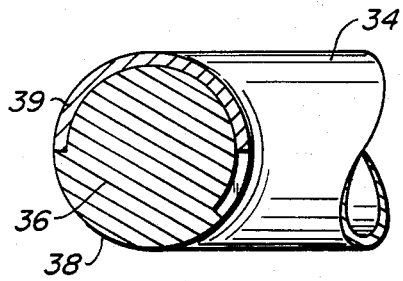
FIG. 5A is a cross-sectional view taken along the line 5A—5A of FIG. 4 showing the configuration of the stop means when the chair is resting on the ground.
Figure 5B:
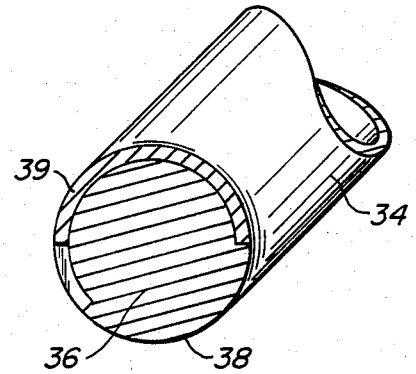
FIG. 5B is the same view showing the stop means when the chair is raised.

In the preferred embodiment the chair is comprised of modular component parts capable of being assembled at the installation site. The modular component parts include a combined rear leg member 10 with cross member 28 already secured thereto, right and left members 31 and 32, a seat member 15, and a back member 16. The seat and back members 15 and 16 may be combined in a single unit as illustrated in FIG. 1. The right and left members 31 and 32 each have a first end portion 33 which provides a front leg of the assembled chair, intermediate portion 34 which provides an arm rest of the assembled chair, and a second end portion 35 which is adapted for rotary mounting on cross member 28. As illustrated in FIG. 4, end 35 of right or left member 31 or 32 is provided with cylindrical extension 36, which is dimensioned to fit within tubular cross member 28 and rotate freely therein. End 35 and cross member 28 are cooperatively formed as at 37 to provide stop means for limiting the angle through which the chair can be pivoted about horizontal axis 13. End 35 and tubular cross member 28 are each provided with engagement lips 38 and 39, which cooperate to allow limited rotary motion of the chair about horizontal pivot axis 13, say to an angle of 45°. FIGS. 5A and 5B show the relative configuration of lips 38 and 39 in these two positions.

Seat member 15 and back member 16 are preferably formed as a single unit of wire mesh. The wire mesh is preferable because it is lighter weight, making the chair easier to manipulate, and is less susceptible to defacing or graffiti. Seat and back members 15 and 16 are provided with protruding tabs 41 which extend into apertures 42 in right and left members 31 and 32. The right and left members are secured to the seat and back members by fasteners 43, which are preferably provided by single-direction bolts, which screw into tabs 41. The use of single-direction fasteners provides for quick assembly at the installation site, which cannot be undone by vandals. Of course, right the left members 31 and 32 can be spot-welded to seat and back members 15 and 16, but this tends to mar the finish of the chair.

In operation, a person desiring to change the direction in which the chair faces, need merely grasp an arm rest of the chair, exert a slight lifting motion while simultaneously turning the chair to the desired direction, and then lower the chair to its new position. The chair design disclosed herein requires no complicated instructions for its use, but rather provides an immediate suggestion, by virtue of its very design, of the characteristic horizontal circular movement. The ease with which the chair may be selectively positioned comes about because the lines of the chair design itself provide vertical and horizontal lever arms giving the user a substantial mechanical advantage in selectively positioning the chair. Any attempt to move the chair will automatically produce the proper motion, because of the positions of the effective lever arms. Moreover, the chair design is accomplished with a minimum of materials and weight, further lending to ease of manipulation.

A chair constructed in accordance with the invention may have two or three legs, but not more. A first leg is needed to define the approximately vertical pivot axis, which is located at the rear of the chair. In addition, the chair is provided with one central leg or two front legs for stable support. More legs would unnecessarily increase the weight of the chair. Moreover, it would make the chair more difficult to set down in stable position on an uneven surface, as is typically found outdoors.

In summary, the invention provides an outdoor chair which is particularly suited to the needs of public gathering places. It can be selectively positioned by a user to facilitate conversation with persons seated in similar chairs situated nearby, or it may be turned away to provide a measure of privacy, according to the desires of the user. The chair is durable and aesthetically pleasing and does not lend itself to vandalism. Moreover, the very design of the chair tells a user how the chair is to be manipulated so as to be positioned in any desired direction.

While the above provides a full and complete disclosure of the preferred embodiment of the present invention, various modifications, alternate constructions and equivalents may be employed without departing from the true spirit and scope of the invention. For example, with the benefit of this disclosure, other constructions will occur to one skilled in the art for providing the disclosed combination of pivotal movements. Therefore, the above description and illustration should not be construed as limiting the scope of the invention, which is defined by the appended claims.

What is claimed is:

1. A modular assembly of component parts capable of being assembled into a selectively positionable chair for permanent installation outdoors, said assembly comprising:

a rear leg member comprising an elongate first member adapted at one end to be fixed in the ground and a second member mounted on said first member for pivotal movement about the longitudinal axis thereof, said second member being provided with a cross member perpendicular thereto defining a horizontal pivot axis in the assembled chair;

right and left members, each having a first end portion formed to provide a front leg to the assembled chair, an intermediate portion formed to provide an arm rest of the assembled chair, and a second end portion, each said second end portion and said cross member being adapted for rotary mounting so that said right and left members pivot about said horizontal pivot axis in the assembled chair; and a seat member and a back member adapted to be secured to said right and left members.

2. The assembly of claim 1, wherein said second member is irremovably mounted on said first member.

3. The assembly of claim 1, wherein the second end portions of said right and left members and said cross member are further adapted to limit the angle through which said right and left members pivot about said horizontal axis in the assembled chair.

4. A selectively positionable chair for permanent installation outdoors comprising:

a single rear leg member comprising an elongate first member adapted at one end to be fixed in the ground and a second meber irremovably mounted on said first member for pivotal movement about the longitudinal axis thereof, said second member being provided with a tubular cross member perpendicular thereto defining a second pivot axis perpendicular to said longitudinal axis;

a right member and a left member, each having a first end portion providing a front leg of said chair, an intermediate portion providing an arm rest of said chair, and a second end portion coaxially mounted to said cross member for rotary movement about said second pivot axis; and a seat member and a back member secured to said right and left members.

5. The chair of claim 4, wherein said elongate first member is provided with means fixing the distance which said first member extends into the ground and said cross member is positioned on said second member a predetermined distance from said last-named means so as to position said second pivot axis proximate the upper edge of said back member.

6. The chair of claim 4, wherein said right and left members and said cross member are provided with stop means for limiting the angle through which said chair pivots about said second pivot axis.

7. The chair of claim 4, wherein said seat member and said back member are formed of wire mesh to provide a light-weight construction.

* * * * *